US005634420A

United States Patent [19]

Huisman

[11] Patent Number: 5,634,420

[45] Date of Patent: Jun. 3, 1997

[54] SWIVEL DEVICE

[75] Inventor: Wolter Huisman, Vollenhove, Netherlands

[73] Assignee: Rondal B.V., Netherlands

[21] Appl. No.: 553,269

[22] PCT Filed: Mar. 24, 1995

[86] PCT No.: PCT/NL95/00114

§ 371 Date: Apr. 1, 1996

§ 102(e) Date: Apr. 1, 1996

[87] PCT Pub. No.: WO95/26295

PCT Pub. Date: Oct. 5, 1995

[30] Foreign Application Priority Data

Mar. 25, 1994 [NL] Netherlands ..... 9400484

[51] Int. Cl.[6] ..... B63H 9/04

[52] U.S. Cl. ..... 114/107; 114/108

[58] Field of Search ..... 114/89, 90, 91, 114/92, 93, 102, 103, 104, 105, 106, 107, 108

[56] References Cited

U.S. PATENT DOCUMENTS 3,285,215 11/1966 Potter ..... 114/106

FOREIGN PATENT DOCUMENTS 78230 5/1983 European Pat. Off. ..... 114/106
0229675 7/1987 European Pat. Off. .
1192696 5/1970 United Kingdom .

*Primary Examiner*—Stephen Avila
*Attorney, Agent, or Firm*—Webb Ziesenheim Bruening Logsdon Orkin & Hanson, P.C.

[57] ABSTRACT

The invention relates to a mast and boom coupled thereto by means of a coupling means for a sailing boat, which includes: an elongate structure which bounds a cavity extending in a longitudinal direction; a slotted hole extending on the top side thereof in the longitudinal direction; and a winding member rotatably drivable by drive means and extending in the cavity in the longitudinal direction for winding up and unwinding a sail movable through the slotted hole. The combination of the mast and the boom according to the invention has the special feature that the coupling means includes: a first support coupled to the mast, a second support coupled thereto for rotation round a rotation axis in a plane extending at least more or less perpendicularly of the mast, to which second support, and particularly to the underside thereof, the boom is fixed, and which second support has a continuous slot-like opening which lies in register with the slotted hole in the boom and serves for passage of the foremost zone of the sail facing toward the mast, this such that the edge of the foremost zone of the sail extends in the region of the rotation axis.

8 Claims, 5 Drawing Sheets

SWIVEL DEVICE

BACKGROUND OF THE INVENTION

The invention relates to a mast and boom coupled thereto by means of coupling means for a sailing boat, in which a boom includes:

an elongate structure which bounds a cavity extending in longitudinal direction;

a slotted hole extending on the top side thereof in longitudinal direction; and a winding member rotatably drivable by drive means and extending in the cavity in longitudinal direction for winding up and unwinding a sail movable through the slotted hole.

It is an object of the invention to support the boom for rotation in an at least more or less horizontal plane round the mast such that the potential rotation angle has a considerable value, in the order for instance of ±90° or even more.

A further object of the invention is to provide a combination of a mast and a boom, wherein the coupling means are embodied such that the edge of the foremost zone of the sail, irrespective of the reef situation of this sail, is always situated at the place of entry thereof into the boom at substantially the same position in relation to the boom.

SUMMARY OF THE INVENTION

For this purpose the combination of the mast and the boom according to the invention has the special feature that the coupling means include:

a first support coupled to the mast, a second support coupled thereto for rotation round a rotation axis in a plane extending at least more or less perpendicularly of the mast, to which second support, and particularly to the underside thereof, the boom is fixed and which second support has a continuous slot-like opening which lies in register with the slotted hole in the boom and serves for passage of the foremost zone of the sail facing toward the mast, this such that the edge of the foremost zone of the sail extends in the region of the rotation axis.

The coupling means can be embodied in any suitable material. Particularly suitable are high quality construction materials such as aluminium of a chosen type, titanium, stainless steel or the like.

BRIEF DESCRIPTION OF THE DRAWINGS

The invention will now be elucidated with reference to the annexed drawings. Herein.

DESCRIPTION OF THE PREFERRED EMBODIMENT

Figure 1:
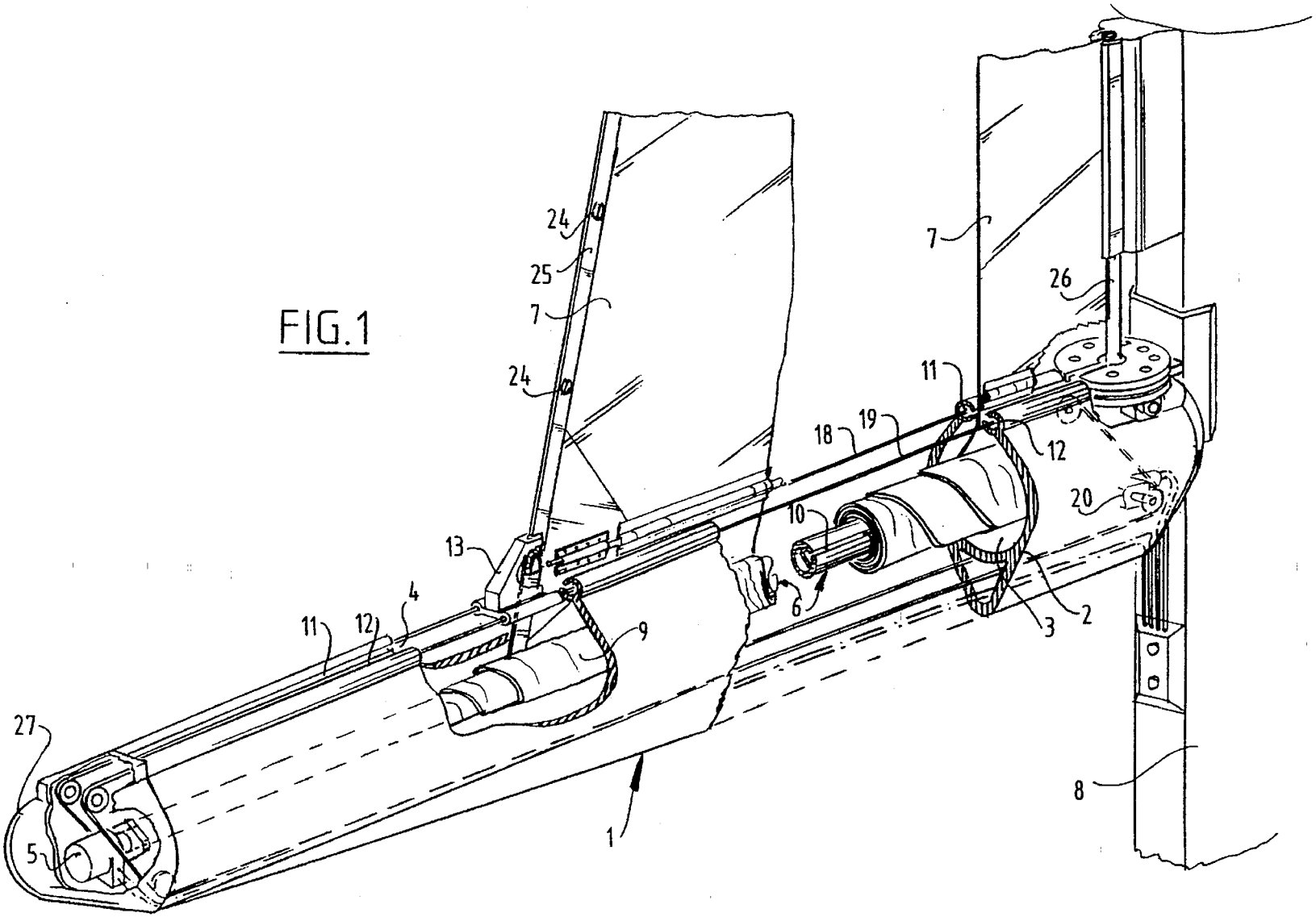
FIG. 1 shows a partly broken away perspective view of a first embodiment of the structure according to the invention.

FIG. 1 shows a boom 1 according to the invention in a first embodiment. Boom 1 comprises an elongate structure 2 of aluminium which bounds a cavity 3 extending in lengthwise direction, a slotted hole 4 extending on the top side of the structure 2 thereof in lengthwise direction and a winding shaft 6 drivable by a motor 5 and extending in lengthwise direction for winding up and unwinding a sail movable through the slotted hole 4. The motor 5 serves particularly to exert a downward directed tensile force on a sail 7 which is connected guidably in vertical direction to a mast 8. The winding shaft 6 serves particularly to pull through the slotted hole 4 into the cavity 3 and store therein a part 9 of the sail 7 for placing out of use. The winding shaft 6 is preferably embodied more or less with torsional stiffness. Sail 7 is inserted into shaft 6 via an undercut longitudinal channel 10 by means of a widened bottom edge into which for instance a cable is woven.

Figure 2:
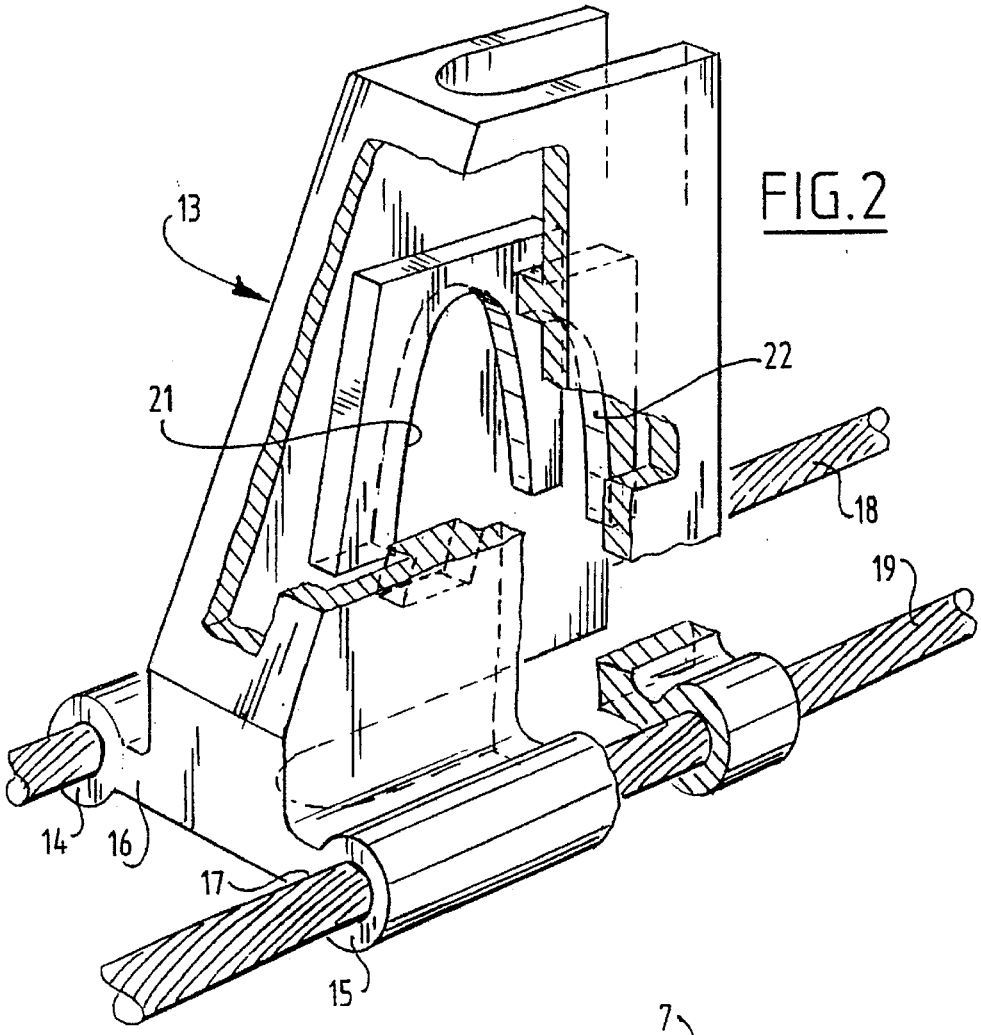
FIG. 2 shows a partly broken away perspective view on enlarged scale of the carriage with hooking means as according to FIG. 1.

The slotted hole 4 is bounded by two mutually parallel prismatic edges 11, 12 in which a carriage 13 is received slidably for movement therealong. The edges 11, 12 have a curved form with mutually facing openings, while carriage 13, as can be seen particularly in FIG. 2, has widened side parts 14, 15 having a partially cylindrical form which fit into the cavities in edges 11, 12, which parts 14, 15 are coupled to the rest of the carriage 13 via narrowed bridges 16, 17 respectively which are narrow enough to pass through the longitudinal openings in edges 11, 12, while the side parts 14, 15 are too wide to do so. The carriage 13 is thus slidably accommodated between the edges, while it blocks a relative displacement of these edges 11, 12 away from each other. In the embodiment shown in FIGS. 1 and 2 the carriage 13 is coupled via the side parts 14, 15 to mutually parallel cables 18, 19 which are displaceable by means of a schematically designated motor 20 with co-movement of the carriage 13. The co-action between motors 5 and 20 will be further discussed hereinbelow.

Figure 3:
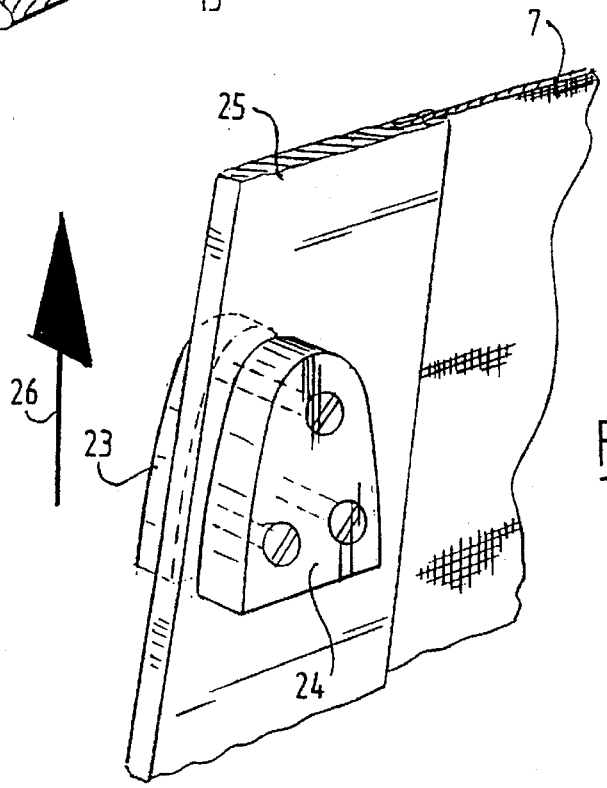
FIG. 3 shows the leech of the sail to which are fixed hooking protrusions for co-action with the carriage according to FIG. 2.

The carriage 13 comprises two hooks 21, 22 which extend on either side and which are open on the underside and are thus accessible by the correspondingly formed blocks 23, 24 shown in FIG. 3 which are connected to the upward inclining, strengthened free edge 25 of sail 7, and are arranged at a number of positions thereon as shown in FIG. 1, and which block the upward directed movement 26 of the sail 7 under load.

In order to wind up the sail 7 the motor 5, preferably a hydraulic motor, is energized. A downward directed force is hereby exerted on the sail 7, whereby the connection between the blocks 23, 24 and the hooks 21, 22 is broken. After reaching a desired position the connection between following sets of blocks 23, 24 on the one hand and hooks 21, 22 on the other can be restored after a displacement of carriage 13 is performed via cables 18, 19 by energizing the hydraulic motor 20 such that the carriage is placed at the correct position.

For downward movement of the sail 7 under the influence of the motor 5 the upward directed forces on the sail have to be neutralized, at any rate limited. For this purpose a tensile force exerted on the reinforced leading edge or luff 26 of the sail can be neutralized by means of unshown means. For the reverse movement, wherein the sail part 9 is unwound from shaft 6, an upward directed force can, while the motor 5 applies a certain braking force, be exerted on the luff 26 after the coupling between blocks 23, 24 and hooks 21, 22 has been made inactive by energizing the motor. By energizing the motor 20 the carriage 13 is displaced in the direction of the free end 27 of the boom to a desired new coupling position between a set of blocks 23, 24 and the hooks 21, 22.

Figure 4:
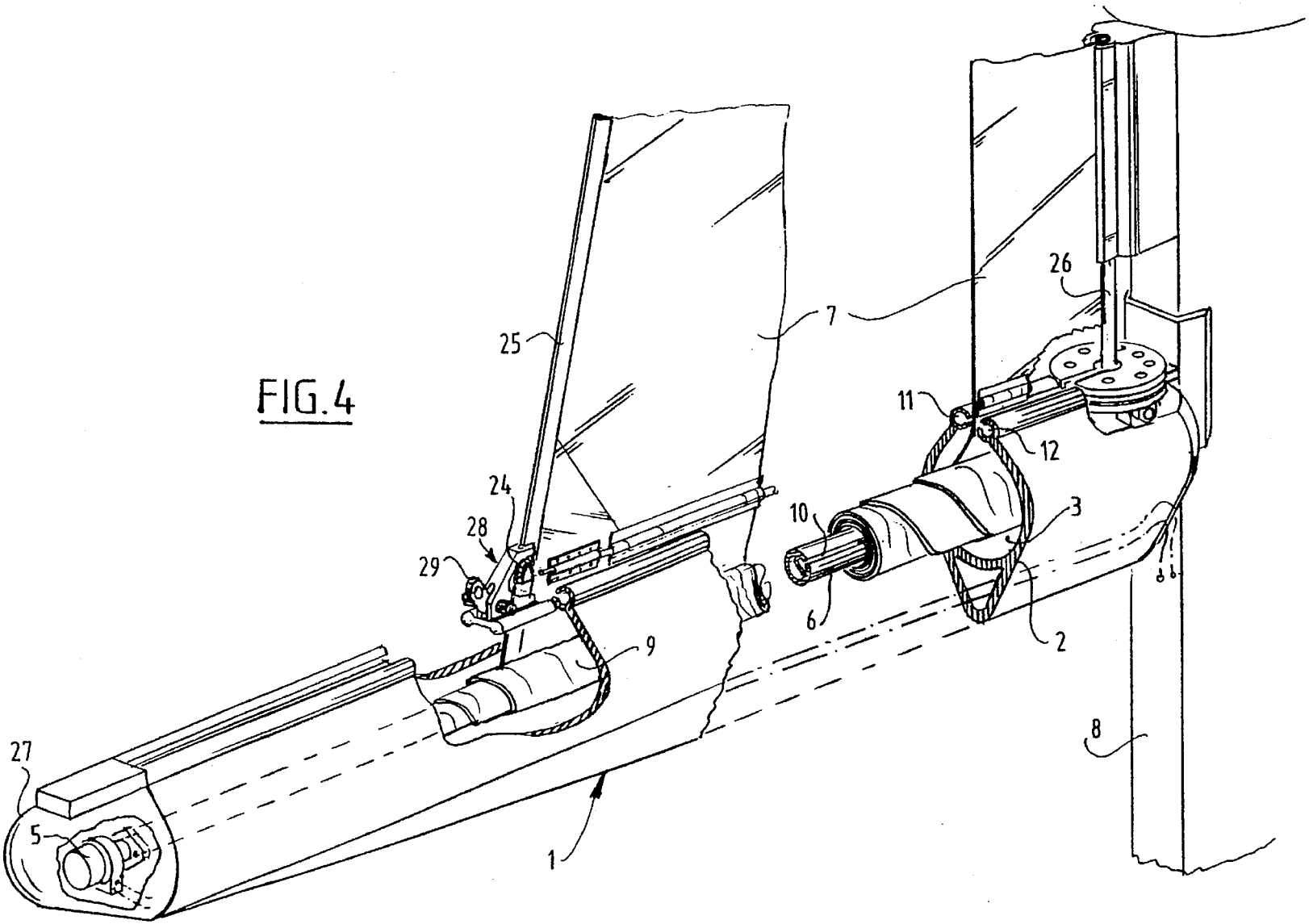
FIG. 4 shows a view corresponding with FIG. 1 of a variant.

FIG. 4 shows a variant in which the carriage 28 is manually slidable along the edges 11, 12. By means of a spring-loaded braking mechanism the carriage 28 retains a chosen position relative to the boom 1. By depressing a control lever 29 the rigid coupling between carriage 28 and boom 1 is released and carriage 28 can slide. The structure according to FIG. 4 is .otherwise the same as that according to FIG. 1.

Figure 5:
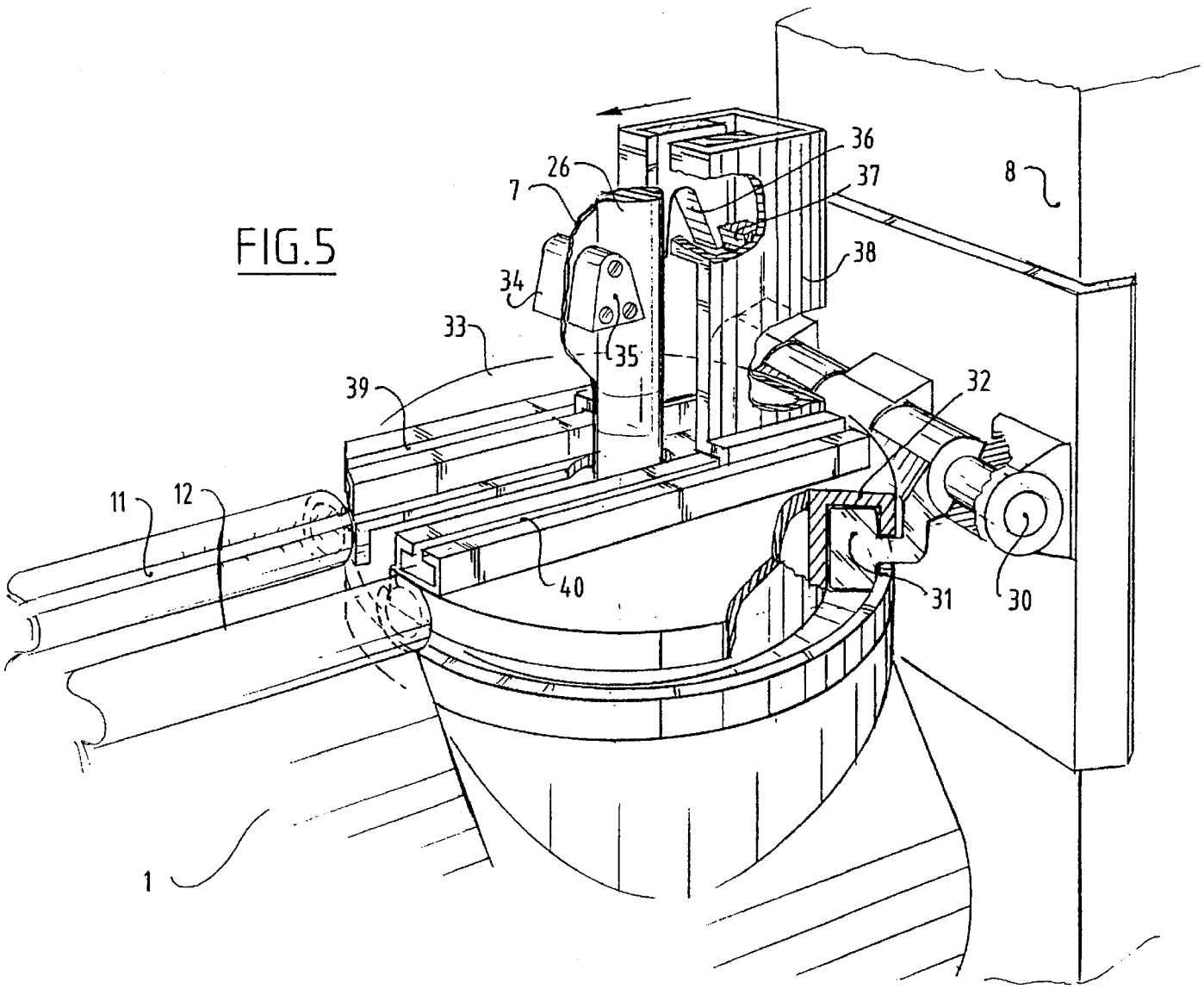
FIG. 5 shows a partly broken away perspective view of a swivel device of another type than shown in FIGS. 1 and 4.

FIG. 5 shows the manner in which the boom 1 is coupled to the mast 8. The latter supports via a hinge 30 a guide rail 31 curved in a circular arc with which co-acts a correspondingly formed slide channel 32 with the undercut form shown in FIG. 5. The slide channel 32 is thus rotatable, wherein the luff 26 extends in the middle zone of the rotation. The channel 32 forms part of a support disc 33 to which the boom 1 is connected.

As previously stated, the front edge of the sail 7, that is, the zone adjoining the luff 26, also comprises blocks 34, 35 which are arranged at mutual distances and correspond with the blocks 23, 24 and which can co-act with correspondingly formed hooks 36, 37 in a hooking body 38 which is coupled to the support disc 33 for tensile strength and for sliding by means of undercut longitudinal recesses 39, 40.

The structure shown in FIG. 5 ensures that when the boom 1 with sail 7 rotates round an approximately vertical axis the luff 26 remains situated in substantially the same position relative to boom 1. Winding up and unwinding of the sail respectively onto and from the winding shaft 6 is hereby possible in all positions, without substantial change.

Figure 6:
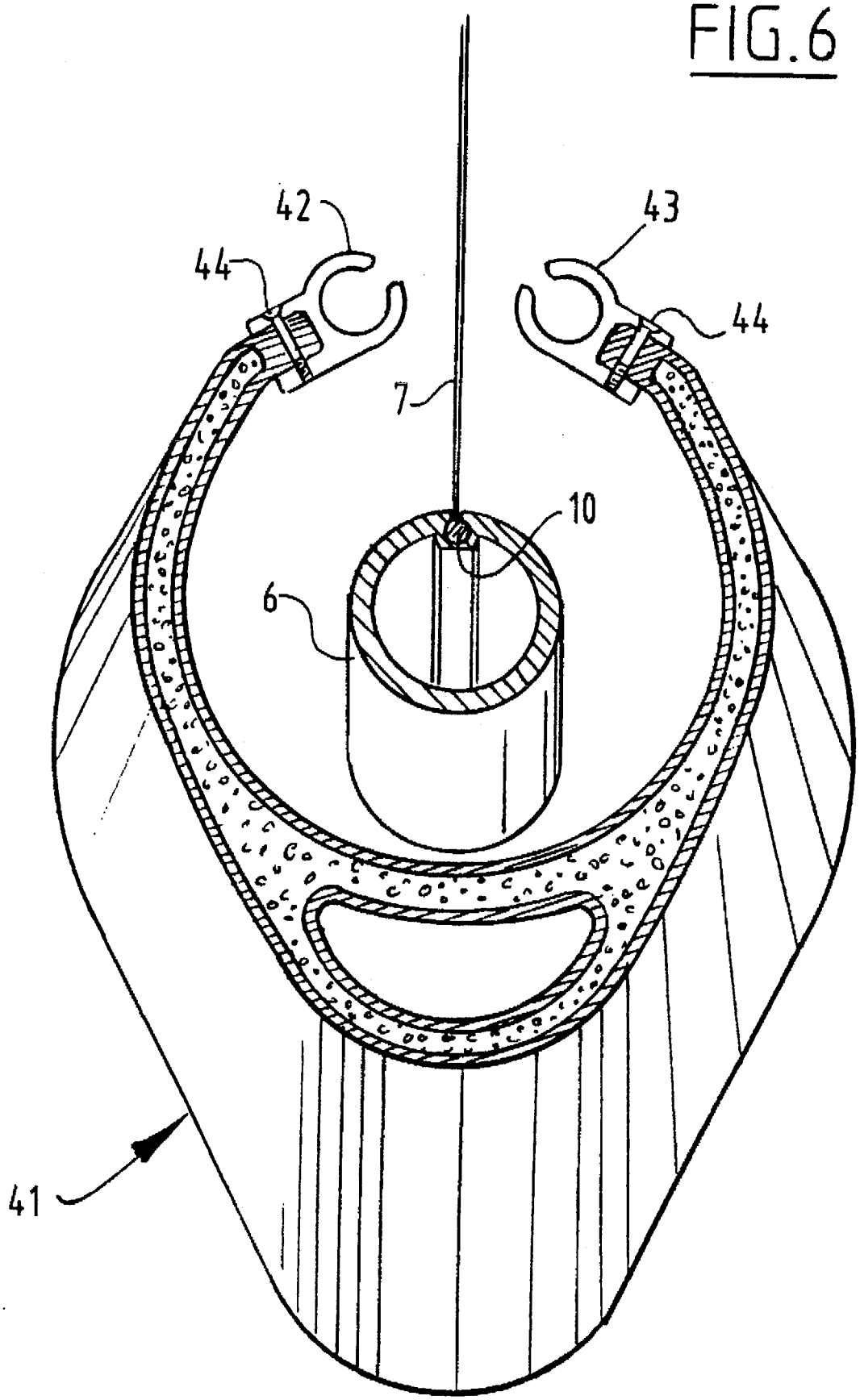
FIG. 6 shows a rear view of the boom in another embodiment with covering removed.

FIG. 6 shows a rear view of a boom 41 in another embodiment.

In contrast to boom I as according to FIGS. 1–4, the boom 41 is provided with coupling edges 42, 43 of aluminium, which coupling edges 42, 43 are manufactured by extrusion. The edges 42, 43 are connected to the rest of the boom 41 by glueing and making use of bolts 44.

What is claimed is:

1. A mast and boom coupled thereto by means of coupling means for a sailing boat, comprising: a boom, said boom including an elongate structure which bounds a cavity extending in a longitudinal direction, having a top side a slotted hole extending on the top side thereof in said longitudinal direction, and a winding member rotatably drivable by a drive means and extending in the cavity in said longitudinal direction for winding up and unwinding a sail movable through the slotted hole; and a coupling means, said coupling means including a first support coupled to the mast, a second support coupled thereto for rotation round a rotation axis in a plane extending at least more or less perpendicularly of the mast, to which said second support, and particularly to an underside thereof, the boom is fixed, and which said second support has a continuous slot-like opening which lies in register with the slotted hole in the boom and serves for passage of a foremost zone of the sail facing toward the mast, this such that an edge of the foremost zone of the sail extends in a region of the rotation axis.

2. The mast and boom as claimed in claim 1, wherein the second support has at least one profile opening to the outside and having the shape of a circular arc, into which said profile protrudes at least one support element which forms part of the first support and which is concentric in the form of a circular arc to the said rotation axis.

3. The mast and boom as claimed in claim 2, wherein the profile opens onto the outer surface and has an undercut form.

4. The mast and boom as claimed in claim 1, wherein the coupling means includes a hinge with a pivot axis extending substantially perpendicularly of the mast and the boom such that the boom is pivotable substantially vertically.

5. The mast and boom as claimed in claim 4, wherein the hinge is arranged between the first support and the second support.

6. The mast and boom as claimed in claim 4, wherein the hinge is arranged between the second support and the boom.

7. The mast and boom as claimed in claim 5, further including a blocking means arranged on the second support for blocking an upward directed displacement of the foremost zone of the sail.

8. The mast and boom as claimed in claim 7, wherein the blocking means is adapted for co-action with sail battens forming part of the sail.

* * * * *